United States Patent [19]

Bartschke

[11] Patent Number: 4,752,200

[45] Date of Patent: Jun. 21, 1988

[54] APPARATUS FOR A CONTROLLABLE PRESS EJECTION SYSTEM

[75] Inventor: Alfred Bartschke, St. Joseph, Mich.

[73] Assignee: Standard Tool & Die, Inc., Stevensville, Mich.

[21] Appl. No.: 16,275

[22] Filed: Feb. 19, 1987

[51] Int. Cl.[4] ..... B28B 7/12

[52] U.S. Cl. ..... 425/139; 249/66 R; 425/422; 425/436 R; 425/444; 425/556

[58] Field of Search ..... 425/422, 438, 436, 436 RM, 425/441, 443, 444, 556, 150, 139; 249/66 R

[56] References Cited

U.S. PATENT DOCUMENTS

| | | | |
|---|---|---|---|
| 756,639 | 4/1904 | Hutchison | 425/422 |
| 2,336,982 | 10/1940 | Cremer | 425/78 |
| 2,407,123 | 9/1943 | Allison | 425/416 |
| 2,485,283 | 10/1949 | Guelph | 425/444 |
| 3,040,378 | 6/1962 | Rodgers et al. | 425/556 |
| 3,172,155 | 3/1965 | Wenzel | 425/408 |
| 3,290,724 | 12/1966 | Rondum | 425/444 |
| 3,307,223 | 3/1967 | Jacobs | 425/575 |
| 3,337,916 | 8/1967 | Smith | 425/78 |
| 3,645,658 | 2/1972 | DeTroyer | 425/78 |
| 3,671,159 | 6/1972 | Greenberg et al. | 425/556 |
| 4,204,824 | 5/1980 | Paradis | 425/436 |

OTHER PUBLICATIONS

"Design of Sheet Metal Bending, Forming and Drawing Dies" from Tool Design, 3rd. Edition, McGraw/-Hill by Donaldson, Lecain, Gold.

*Primary Examiner*—Jay H. Woo
*Assistant Examiner*—C. Scott Bushey
*Attorney, Agent, or Firm*—Jeffers, Hoffman & Niewyk

[57] ABSTRACT

A compact, controllable ejection system for use with trimming presses and forming presses. A preferred form of the invention has a remotely located sealed enclosure filled with a compressible gas and into which an incompressible fluid is introduced through a pressure line. The other end of the pressure line connects to a conventional hydraulic cylinder, the piston of which is connected to an ejector pin. During closure of the press the ejector pin is forced upwards thereby forcing fluid into the remotely located sealed enclosure. A controllable directional valve entraps the forcibly introduced incompressible fluid and the energy stored in compressing the compressible fluid. After the opening of the press, at a controlled time such as when an automated receiving tray has been inserted to receive the part, the controllable valve is opened, ejecting the part from the press.

8 Claims, 2 Drawing Sheets

APPARATUS FOR A CONTROLLABLE PRESS EJECTION SYSTEM

FIELD OF THE INVENTION

This invention concerns forming or trimming presses and more particularly a method and apparatus providing controlled ejection of articles trimmed or formed in such presses.

BACKGROUND OF THE INVENTION

Machine presses for the forming and trimming of intermediate articles into higher level intermediate articles or into finished parts are well known in the prior art. In a trimming operation the article is placed upon a locator die and cutters are pressed upon the article to cut and shear away undesired material from the article. In a forming operation the article to be formed is placed in a lower die and formed by forcing an upper complementary die into the lower die, thereby imparting the desired shape to the article. In both the trimming and the forming process the stresses involved tend to leave the article with a tight friction fit against the principal shaping part of the machine press. This friction fit, or "nesting", as it is sometimes referred to, is a well known phenomenon. Various systems have been devised for removing or ejecting the nested article after a forming or trimming operation.

One known approach for ejecting articles from a press is to provide ejector springs (compression) connected to a pressure pad which is pushed out of the die or trimming area by the trimming or forming operation. When the pressure pad is pushed out of the die or trimming area during closure of the forming or trimming press, energy is stored within the spring. As the forming or trimming stroke is completed the forming or trimming stresses impinged upon the article by the press are removed and the energy stored in the springs force the pressure pad against the article thereby releasing the article from the press. Thus, after the press closure is completed and press opening begins, the pressure pad pushes the article out of the forming or trimming die, as the case may be.

One of the problems with this known ejecting arrangement occurs when the frictional forces of the article against the sides of the cutter blades or the forming die are too great to be dislodged by the energy that is stored in the spring during the trimming or forming stroke. In such cases the article becomes stubbornly nested or lodged within the press and can be quite difficult to remove. When this occurs, an impact from a rubber hammer or similar device is conventionally used to add force in an attempt to dislodge the article. Pressure or a hammer impact on the pressure pad and/or ejector springs may also be attempted; however, these components are often not directly accessible thereby requiring a partial dismantling of the machine in order to remove the stubbornly nested article. All of these steps require extra time and further impose the risk of damaging the trimmed or formed article, the dies involved, and the press itself. It is therefore desirable to provide an ejection system with facilities for dislodging stubbornly nested articles.

Another problem with the spring-and-pressure-pad energy storage ejection system is that in tight quarters, which occur frequently in the press environment, it is difficult to locate the springs which are necessary to provide sufficient ejection force. It will be appreciated that is desirable to provide an energy storage ejection system that is compact and easy to fit into a low clearance location.

Another problem with the ejection of parts by utilizing a compression spring is that the amount of compression of any spring is limited, and accordingly the length of ejection stroke is also limited. When forming or trimming deep drawn parts, a longer ejection stroke is required than can be accommodated only by the compression of the compression spring. It is therefore desired to provide an ejection system easily adaptable to long ejections strokes.

Still another problem of known ejector systems is that ejection of an article occurs typically immediately upon the return of the press to the open position from the closed forming or trimming position. An immediate ejection in many cases would not allow time for the insertion of a tray or other implement to catch the ejected article in order to carry it to the next manufacturing point. Further, immediate ejection often leaves the article displaced from its initial position which, if coupled with inadvertent subsequent closure of the press, will lead to damage of the article and probably also the press dies and cutters. Thus it may be appreciated that it is desirable to provide a press ejection system in which the time of ejection is controllable, and also to provide an ejection system wherein the press is inhibited from closing until the article is successfully ejected from the press.

SUMMARY OF THE INVENTION

Briefly stated, in its broadest aspect the invention provides an ejector pin, for use with a trimming press or a forming press, and wherein the pin is connected to a piston operating within a cylinder. The piston works against an incompressible fluid for transferring the pressure developed by the press to an enclosed volume containing a incompressible fluid which is connected by conduits with the incompressible fluid in the cylinder. The enclosed volume also contains a compressible fluid which operates as an energy storage element. Located between the cylinder and the enclosed volume is a controllable directional valve which does not impede the flow of incompressible fluid from the cylinder to the enclosed volume but which does inhibit flow in the opposite direction. The valve may be actuated to open in the reverse direction at which time the energy stored in the compressed fluid will push the incompressible fluid into the cylinder, thereby driving the piston and its associated ejection pin against the article nested in the press. Further, for those situations where the article is stubbornly nested within the press, provision is made for adding energy to the energy which has been stored in the energy storage element. It should also be noted that, with the present invention, the length of the ejection stroke can be made as long as required by simply attaching a long ejection pin to a piston in a cylinder of sufficient length, whereby the ejection system is adaptable to presses with long ejection strokes.

This invention replaces an actual mechanical spring with a fluid spring for driving the ejection pin. A fluid spring may have a very compact design requiring little space and yet is capable of delivering very powerful ejection forces. This is true because the energy storage mechanism can be remotely located from the fluid spring mechanism and can be coupled by a conduit carrying the incompressible fluid between the ejection cylinder and the energy storage unit. Moreover, since the device that provides the ejection energy is remotely located it can be placed in an accessible region where, if need be to dislodge stubbornly nested articles, a source of pressurized fluid may add more energy to the ejection mechanism. In this manner, the article may always be dislodged by the desired ejection pin method regardless of the force required.

The fluid spring could be operated substantially the same as a mechanical spring and eject the article immediately upon the opening of the press except for the controllable direction valve. The insertion of this valve between the ejection cylinder and the energy storage unit delays and controls the ejection until the proper moment. When ejection of the article is desired, the controllable directional flow valve is actuated to release the energy stored in the storage unit to forcibly eject the article from the press. The ejection of the article may be delayed in order to insert a tray for carrying the article to the next manufacturing process, or to allow either a human or a robot to prepare to receive the article. Thus the ejection action is utilized to the most advantageous extent. Moreover, by including a sensor which senses the amount of energy stored in the energy storage unit and using that sensor output as an indication as to whether or not the article has been successfully ejected at the completion of the shaping cycle, a subsequent shaping operation of the press may be inhibited, thereby preventing damage when the previous article has not been properly ejected.

The invention, in one aspect thereof, provides a pressure pad connected to an ejector pin which penetrates through a passage and extends a distance into a volume that will subsequently be forcibly occupied during the trimming operation. This ejector pin is in contact with or is connected to a piston, which operates within a cylinder that is sealed except for an aperture leading into a conduit. The conduit is connected to a controllable directional valve which allows fluid to flow freely from the conduit through the valve but only allows fluid flow in the opposite direction into the conduit upon actuation of the controllable valve. On the other side of the valve is an energy storage unit. The volume enclosed by the cylinder and piston, the conduit, and the valve are filled with an incompressible fluid. Thus, as the press closes against an article, the article exerts a force upon the ejector pin which drives the piston into the cylinder, forcing the incompressible fluid out of the diminishing cylinder volume, through the conduit, through the directional valve and into the energy storage unit. As the incompressible fluid enters the energy storage unit it presses against the energy storage element doing work thereon. As the press opens the controllable directional valve prevents the return of the incompressible fluid back through the conduit into the cylinder thereby prevents the delivery of ejection force or ejection energy to the piston until actuation of the control valve.

In a further aspect of the invention, the energy storage unit is a vertically mounted enclosed volume which has a compressible fluid located above the incompressible fluid. Since differences in density separate the two fluids, no further separation mechanism is required. As incompressible fluid enters the enclosed volume the compressible fluid is compressed in volume and stores energy by an increase in its pressure. The invention, in this further aspect, may also have a valve located at the top of the energy storage unit for the introduction of more compressible fluid into the energy storage unit from a higher pressure source as a means for ejecting stubbornly nested articles from the press. A pressure transducer may also be provided as a sensor to indicate ejection or non-ejection of the article.

In an alternate further embodiment of the invention, within the enclosed volume of the energy storage unit a physical barrier is provided between the incompressible fluid and the compressible fluid in order to keep them separated. This barrier could be a double sided piston or it could be a membrane. This further embodiment also may include a valve for the introduction of more high pressure fluid into the energy storage unit in order to eject a stubbornly nested article from the press. Moreover, if the barrier is a membrane this embodiment of the invention may further comprise a pressure transducer to indicate the ejection or non-ejection of the article from the press. If the barrier comprises a piston, a switch mechanically connected to the barrier piston may be used as an indicator of the ejection or non-ejection of the article from the press.

In yet a further embodiment of the invention the energy storage unit may include a piston for separating the incompressible fluid from a compressible energy storage device such as a spring. The spring side of the piston may be accessible for the introduction of energy from sources other than the spring in order to eject stubbornly nested articles from the press.

It is an object of this invention to provide an ejection system for use with a press in which the ejection operation is controllable in order to sequence the ejection process with further manufacturing processes.

It is another object of this invention to provide a controllable ejection system that has a positive indicating mechanism for determining that the article has been in fact ejected from a nested location in the press.

It is a further object of this invention to provide an ejection system for a press to which external energy can be added as required to dislodge articles stubbornly nested within the press.

It is yet a further object of this invention to provide an ejection system installable into tight locations and yet capable of storing sufficient energy to eject the article.

It is still another object of this invention to provide a long stroke for the ejection pin to accommodate the removal from the press of deep drawn parts after forming or trimming.

These and other objects and features of the present invention will become apparent from the detailed description, taken together with the accompanying drawings.

BRIEF DESCRIPTION OF THE DRAWINGS

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF A PREFERRED EMBODIMENT

Figure 1:
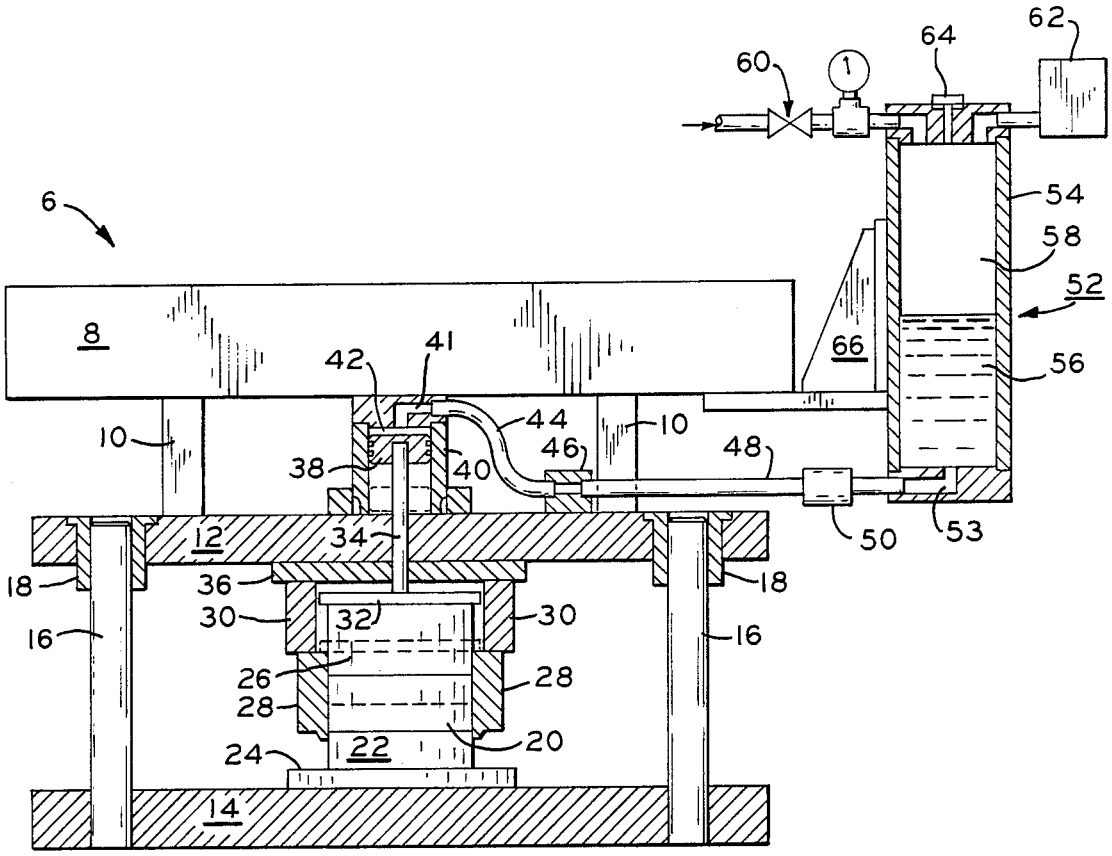
FIG. 1 is a partial cross-sectional view of a trim press in the closed position.

Referring now in detail to the drawings, FIG. 1 illustrates a conventional trim press 6 which is partially shown and has an upper platen 8 attached by supports 10 to upper shoe 12. Upper platen 8 and upper shoe 12 move together towards the lower table of the press (not shown) and the lower shoe 14 which is mounted on the table. While one platen press is shown, it should be understood that the invention has application to presses with more than one platen. Extending upwardly from lower shoe 14 are a number of guide rods 16 which, as upper platen 8 and upper shoe 12 descend, fit within guide apertures 18. These guide rods 16 keep upper shoe 12 aligned with the lower shoe 14 during the trimming operation on article 20.

Figure 2:
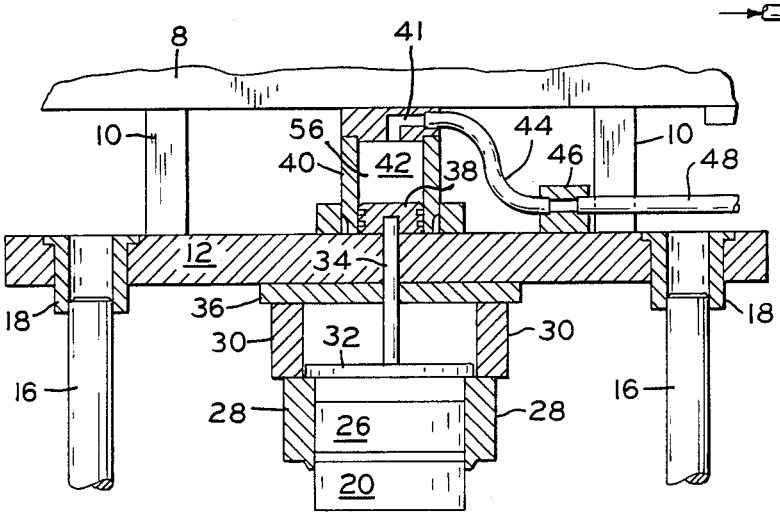
FIG. 2 is a partial, cross-sectional view of a trim press as it initially contacts the article to be trimmed.

At the start of the trimming operation of press 6 article 20 is positioned on locator die 22 which is supported by mounting base 24 upon lower shoe 14 as best shown in FIG. 1. FIG. 2 shows the position of the upper components of the trim press as the upper shoe 12 and platen 8 are in position to descend upon article 20. At the beginning of the descent, ejector pin 34, ejector plate 32, and pressure pad 26 are in their extended position in anticipation of contact with article 20. The guide pins 16 are engaged with guide apertures 18 to give the proper horizontal alignment for cutters 28 to begin to engage article 20 to start the trimming process. Very soon after the trimming process has begun pressure pad 26 makes contact with article 20 which, by means of ejector plate 32, forces ejector pin 34 out of the region of cutters 28 and cutter supports 30. Piston 38 follows the motion of ejector pin 34 and is forced up in cylinder 40, thereby decreasing the volume 42 which is occupied by an incompressible fluid 56. Once the platen 8 and the upper shoe 12 have completely descended, the press 6 is in the closed position as shown in FIG. 1.

Figure 5:
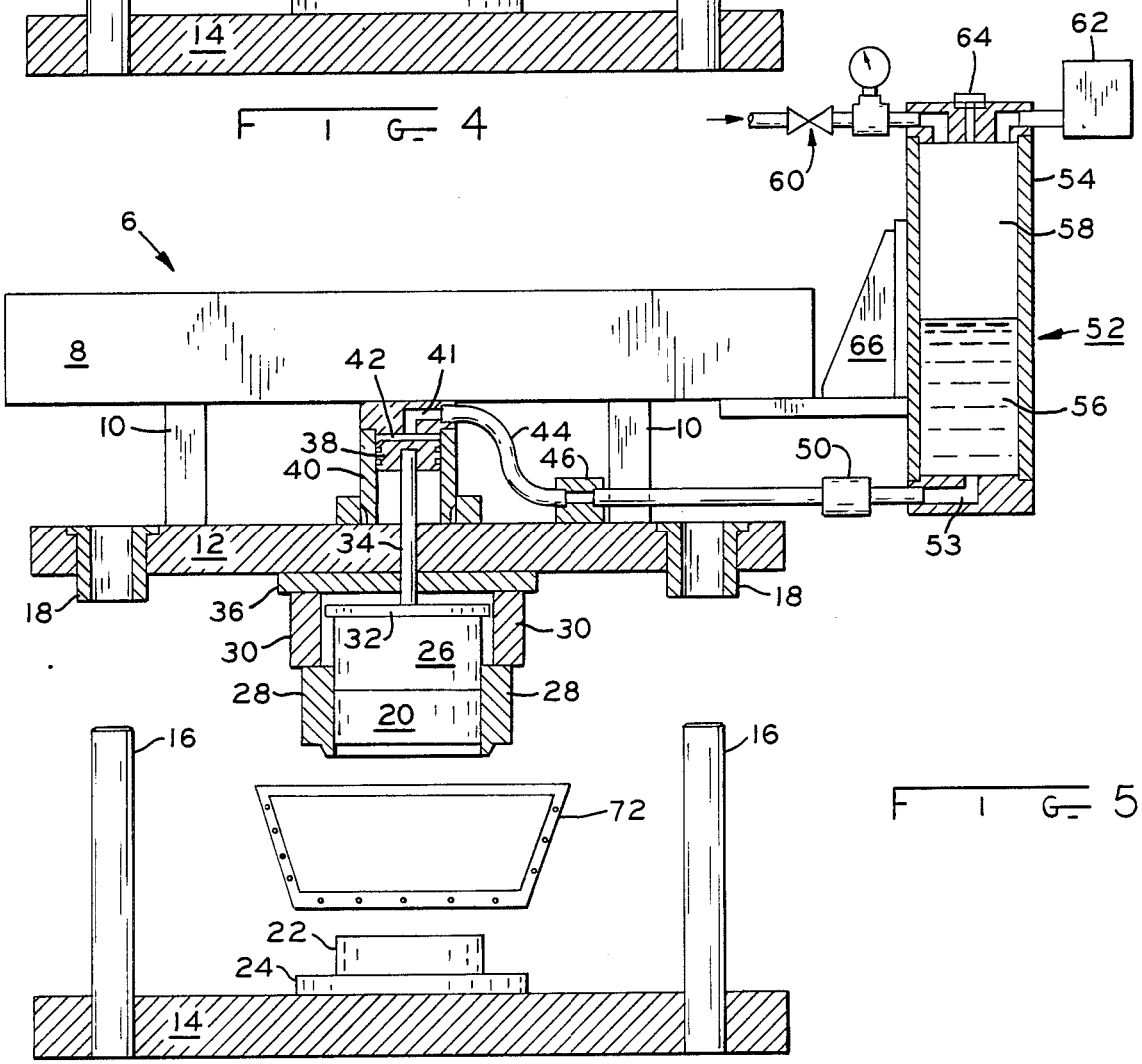
FIG. 5 is a partial sectional view of the press immediately prior to ejection of an article and showing a tray inserted therein for receiving the ejected article.

As the piston 38 ascends within cylinder 40, the volume 42 of incompressible fluid is decreased forcing that fluid under pressure through outlet aperture 41 into pressure line 44. Pressure line 44 is connected to a manifold 46 which connects all such pressure lines from other similar cylinders, if any, to the main pressure line 48. The main pressure line 48 is connected to the controllable directional valve 50 which, during the closing stroke of press 6, allows the incompressible fluid 56 to flow unimpeded from volume 42 through inlet aperture 53 into sealed enclosure 52 but inhibits return flow of the incompressible fluid to the volume 42 and the cylinder 40 as the press 6 moves to the open position as shown in FIG. 5. The controllable directional valve 50 will maintain the equilibrium of the incompressible fluid 56 and the compressible fluid 58 within the enclosed volume 54 thus storing all the energy delivered by the piston 38 by way of the incompressible fluid 56 under pressure into enclosed volume 54 until the controllable release valve 50 is actuated.

FIG. 5 shows platen 8 and upper shoe 12 in the open position with article 20 in the "nested" position frictionally retained within the sides of cutters 28 after a trimming stroke. In this position, ejector pin 34 and piston 38 are in their fully retracted state and with controllable valve 50 closed, no pressure is exerted on piston 38 or pin 34. The pressure within sealed enclosure 52, on the other hand, is quite high as the energy received by the ejector pin 34 and the piston 38 during the trimming stroke is stored in the compressed fluid 58. This elevated pressure is sensed by pressure transducer 62 which provides an indication that the trimmed article has not yet been ejected from the cutters 28. This information from pressure sensor 62 can be used to inhibit closing of the press 6 until ejection of the article 20 from the cutters 28 has taken place.

As shown in FIG. 5, a receiving tray 72 may be placed beneath the cutters 28 to catch article 20 as it is ejected. This tray 72 is representative, as it could be a swinging table or even arms of a robotic device in other embodiments, depending upon the manufacturing installation. Once the receiving tray 72 is in position, the controllable directional valve 50 is opened allowing the compressed fluid 58 to expand thereby forcing the incompressible fluid 56 from enclosed volume 54 through main pressure line 48, manifold 46, pressure line 44, into cylinder 40 and volume 42 to push down piston 38 and the connected ejector pin 34. Ejector pin 34 bears upon ejector plate 32 and pressure pad 26 to force the nested article 20 out of the cutters 28.

For the occasional situation when the article 20 is stubbornly nested within cutters 28 there may be provided a valve 60 connecting enclosed volume 54 to a source of additional pressurized compressed fluid. The additional pressure may then be added to the pressure within enclosed volume 54 to assist the ejection of a stubbornly nested article 20 without having to dislodge the article 20 with a hammer or without having to dismantle the cutters 28 from the cutter supports 30. To ensure that the pressure limitations of the system are not exceeded the sealed enclosure 52 has a safety pressure valve 64 which will not allow the build up of pressure beyond the capabilities of the system.

FIGS. 1 and 5 show the sealed enclosure 52 mounted vertically to a bracket 66 on platen 8. In one embodiment of the invention the incompressible fluid 56 is hydraulic oil and the compressible fluid 58 is nitrogen. Since nitrogen is less dense than and is immiscible with hydraulic oil, gravity will keep the two fluids separated as shown in FIGS. 1 and 5.

Figure 3:
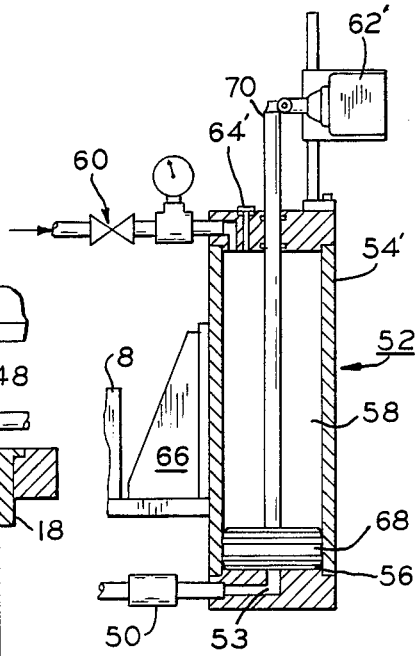
FIG. 3 is a cross-sectional view of an energy storage unit with a piston separating the incompressible and the compressible fluids in the press-open position.

FIG. 3 shows an alternate embodiment of the sealed enclosure 52 having an enclosed volume 54' which is cylindrical, enclosing a piston 68 separating a compressible fluid 58 such as nitrogen and an incompressible fluid 56 such as hydraulic oil. The piston 68 is connected via a piston rod 70, which exits the sealed pressure cylinder 54', and a mechanically actuated electrical switch or a mechanical linkage 62' to indicate the ejection status of the article 20. This indication is used to control subsequent operations of the manufacturing process.

Figure 4:
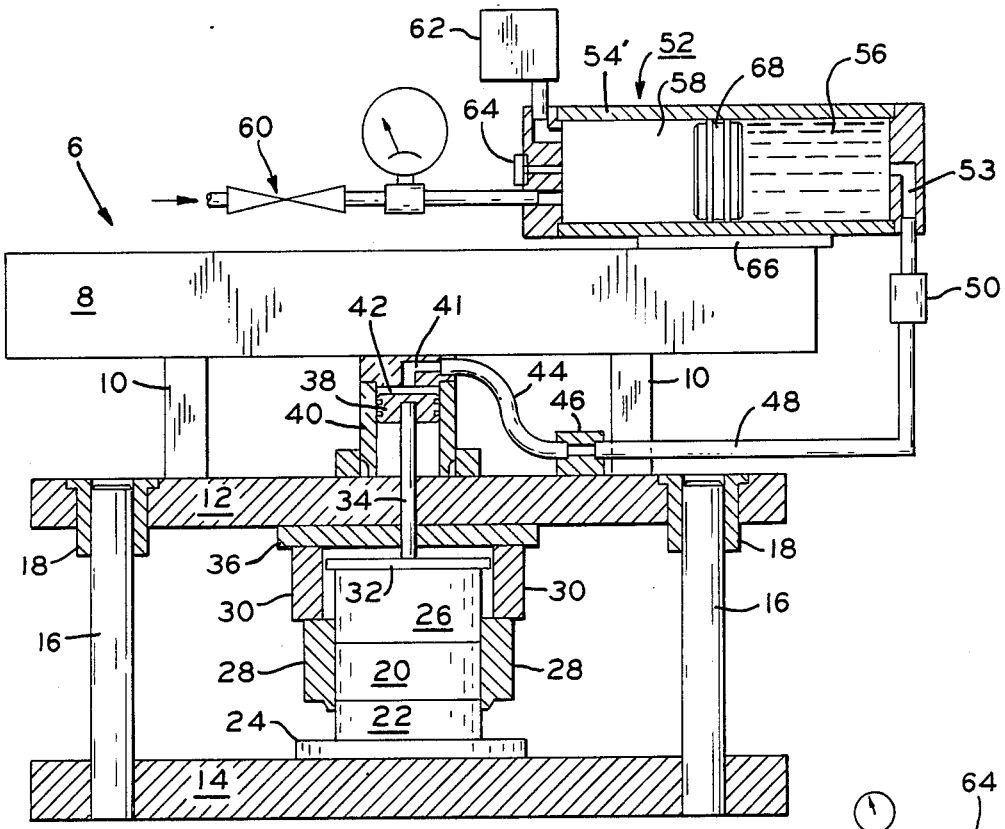
FIG. 4 is similar to FIG. 1 except that the energy storage unit is horizontally mounted and has a double-sided piston separating the compressible and the incompressible fluids.

FIG. 4 shows a press identical to the press shown in FIGS. 1 and 5 except that the sealed enclosure 52 is horizontally mounted. In such a case, a double-sided piston 68 rides within a cylindrical enclosed volume 54' in order to keep the incompressible fluid 56 separate from the compressible fluid 58, since in the horizontal position gravity no longer performs this function properly.

Thus there has been described a controllable ejection system for a trimming press. Those skilled in the art will readily recognize that the invention also has application to a forming press as formed articles are typically lodged by friction within the forming dies. The application of the invention to forming presses is considered to be within the scope of the present invention. Moreover, the preferred embodiment for the energy storage member enclosed within the sealed enclosure 52 is described as a compressible fluid. However, it will be appreciated by those skilled in the art that any compressible media working against a piston upon the incompressible fluid 56 would perform the energy storage function just as well. Therefore, alternative compressible media such as springs which store energy within the sealed enclosure, are also considered to be within the scope of the present invention.

While this invention has been described as having a preferred design, it will be understood that it is capable of further modification. This application is, therefore, intended to cover any further variations, uses, or adaptations of the invention found in the general principles thereof and including such departures from the present disclosure as come within known or customary practice in the art to which the invention pertains and fall within the limits of the appended claims.

What is claimed is:

1. An apparatus for ejecting an article from a press, said press including a platen and an upper shoe, said apparatus comprising:

a cylinder having a closed end and a through aperture therein;

a piston slideably disposed within said cylinder and operatively connected to said upper shoe;

a volume of incompressible fluid contained in said cylinder in a space between said piston and said cylinder closed end;

a sealed container having an inlet and having a volume of compressible fluid therein;

a conduit having a first end connected to said cylinder through aperture and a second end connected to said inlet;

selectively controllable directional valve means connected in said conduit for selectively controlling flow of incompressible fluid from said sealed container to said cylinder;

whereby upon closure of said press, actuation of said piston by said upper shoe causes said volume of compressible fluid to be compressed and whereby, when said press is opened, said valve may be actuated to cause said volume of compressed fluid to apply a force on said piston and said ejector pin for ejecting the article from the press.

2. The apparatus according to claim 1 wherein said compressible fluid comprises a gas.

3. The apparatus according to claim 1 including a second valve operatively associated with said sealed container, a supply of pressurized compressible fluid connected to said sealed container by said second valve, whereby pressurized compressed fluid may be selectively admitted through said second valve means into said sealed container, thereby increasing the force on said piston and ejector pin for ejecting the article from said press.

4. The apparatus according to claim 1 including means responsive to a predetermined pressure of said compressible fluid in said sealed container for inhibiting closure of the press until said predetermined pressure condition is removed.

5. An apparatus for ejecting an article from a press including a die, said apparatus comprising:

energy storage means connected to said die for storing a portion of energy supplied by the press to the die during operation of the press, a directional valve connected to said energy storage means for selectively releasing the energy stored in said energy storage means;

ejecting means connected to said energy storage means for selectively forcibly ejecting the article from the die.

6. An apparatus for ejecting an article from a press including a die, said apparatus comprising:

energy storage means connected to said die for storing a portion of energy supplied by the press to the die during operation of the press, said energy storage means including a container having a volume of compressible fluid therein, a conduit having an incompressible fluid therein connected to said energy storage means, a controllable directional valve in circuit therewith for selectively controlling flow of said incompressible fluid through said conduit whereby energy stored in said energy storage means may be released, and ejecting means including a piston and an associated ejector pin connected to said energy storage means, whereby, upon actuation of said valve, incompressible fluid flows through said conduit thereby causing said piston and associated pin to eject said article from said press.

7. The apparatus according to claim 6 including a conduit for connecting said container to said die, and wherein said directional valve comprises a valve connected in said conduit for selectively controlling fluid flow through said conduit.

8. The apparatus according to claim 6 including a source of compressed fluid and means for operably connecting said source of compressed fluid to said energy storage means for supplying additional energy to said energy storage means.

* * * * *